United States Patent [19]

Braddick

[11] Patent Number: 4,690,220

[45] Date of Patent: Sep. 1, 1987

[54] TUBULAR MEMBER ANCHORING ARRANGEMENT AND METHOD

[75] Inventor: Britt O. Braddick, Houston, Tex.

[73] Assignee: Texas Iron Works, Inc., Houston, Tex.

[21] Appl. No.: 729,231

[22] Filed: May 1, 1985

[51] Int. Cl.[4] ..... E21B 23/06

[52] U.S. Cl. ..... 166/382; 166/124; 166/138

[58] Field of Search ..... 166/123–125, 166/134, 138, 139, 140, 181, 182, 209, 210, 216, 217, 382, 387

[56] References Cited

U.S. PATENT DOCUMENTS

| | | | |
|---|---|---|---|
| 3,223,170 | 12/1965 | Mott | 166/208 |
| 3,519,074 | 7/1970 | Berryman | 166/123 |
| 3,631,927 | 1/1972 | Young | 166/125 X |
| 4,176,715 | 12/1979 | Bigelow et al. | 166/138 |
| 4,248,300 | 2/1981 | Braddick | 166/250 |
| 4,281,711 | 8/1981 | Braddick et al. | 166/118 |
| 4,562,889 | 1/1986 | Braddick | 166/217 X |
| 4,572,290 | 2/1986 | Clifton | 166/123 |

*Primary Examiner*—Stephen J. Novosad
*Assistant Examiner*—David J. Bagnell
*Attorney, Agent, or Firm*—Jack W. Hayden

[57] ABSTRACT

Apparatus releasably supported on a setting string responds to manipulation of the setting string to release therefrom and anchor to a tubular member. A member on the setting string is provided with a tubular member engaging arrangement which responds to further manipulation of the setting string to anchor the member in the tubular member. A disconnect is operable upon manipulation of the setting string to disconnect the setting string from the anchored member and a release arrangement enables the disconnected setting string to release the anchored apparatus from the tubular member.

18 Claims, 12 Drawing Figures

FIG. 2
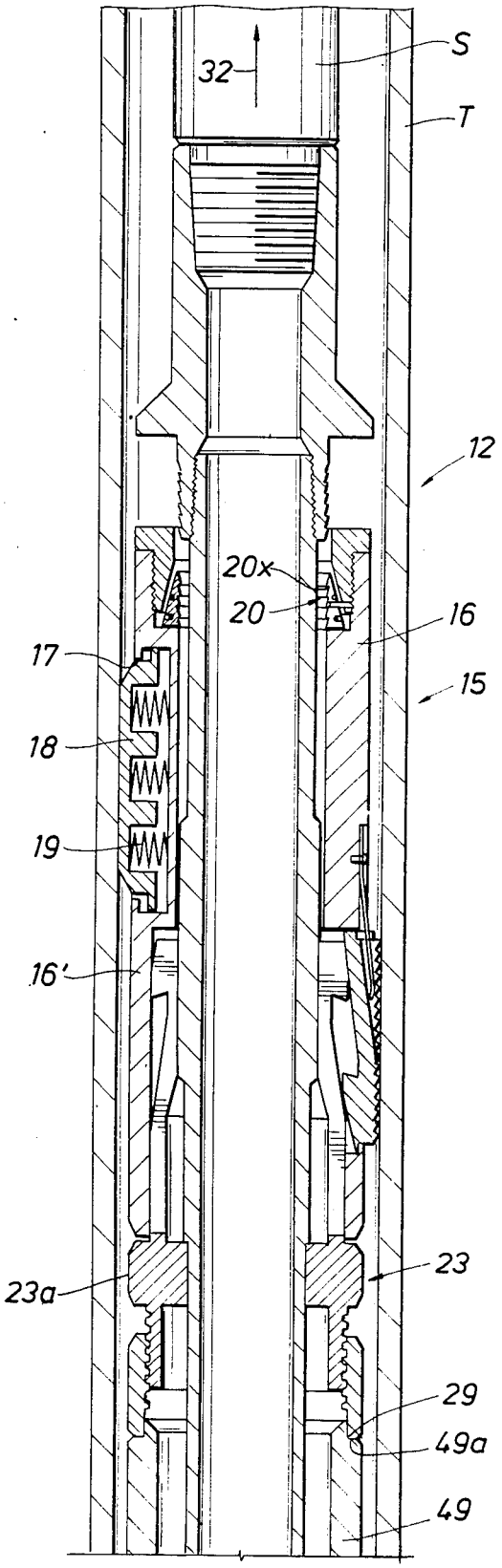
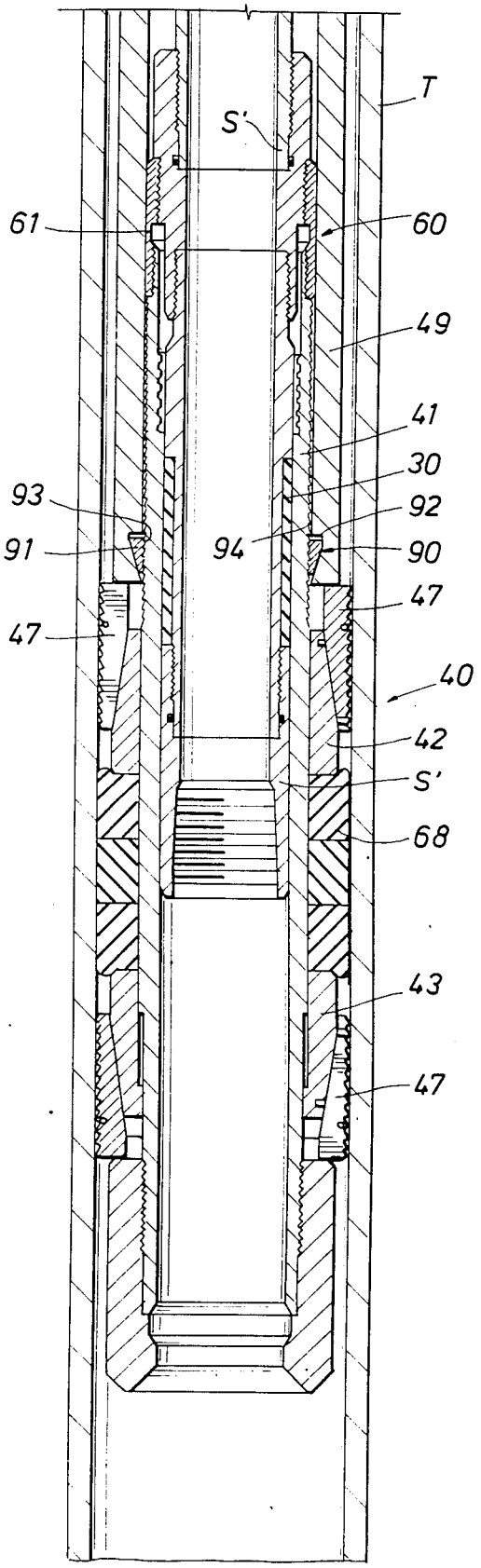
FIG. 3

FIG. 6
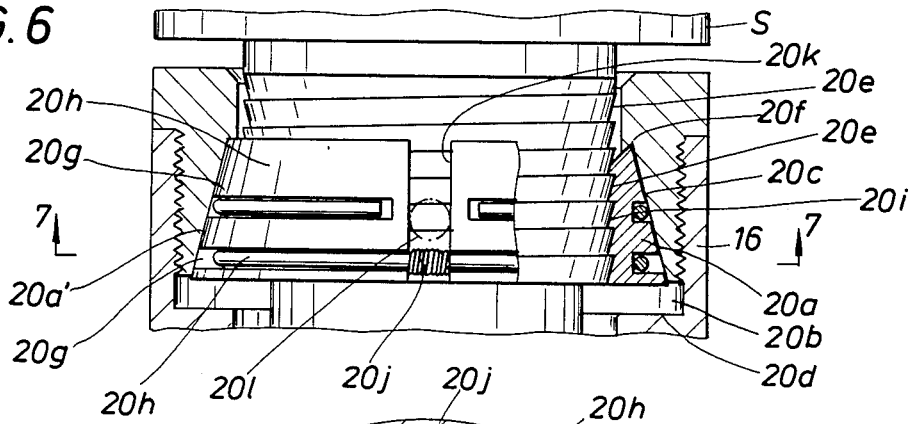
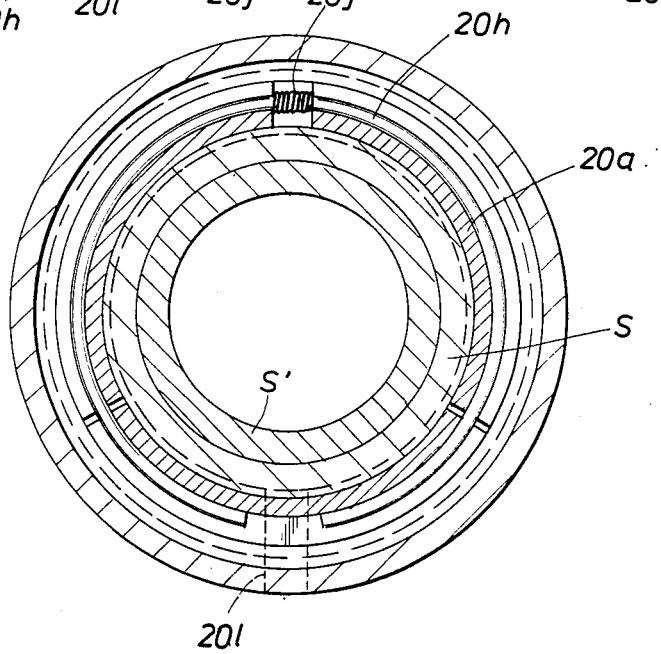
FIG. 7
FIG. 9
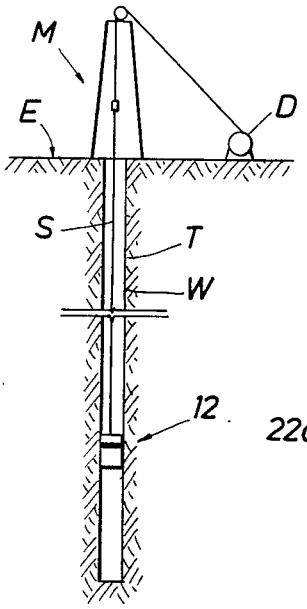
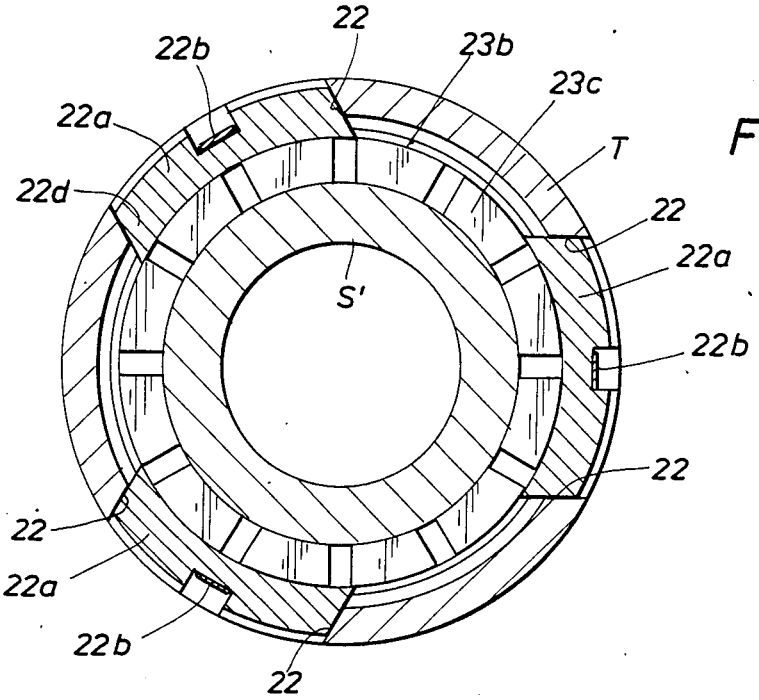
FIG. 8

TUBULAR MEMBER ANCHORING ARRANGEMENT AND METHOD

CROSS REFFERENCE TO RELATED APPLICATIONS

This patent application relates to tubular member anchoring arrangements and methods of the general type referred to in application Ser. No. 06/602,538 filed on Apr. 20, 1984, now U.S. Pat. No. 4,646,842, for "Retrievable Well Bore Assembly" and in Application Ser. No. 729,733 filed on May 2, 1985 for "Retrievable Landing Method and Assembly For a Well Bore".

FIELD OF THE INVENTION

The present invention relates to tubular member anchoring arrangements and methods whereby various members such as packer bore receptacles, tools, landing nipples, packers, and other devices may be positioned in a tubular member.

DESCRIPTION OF PRIOR ART

Two types of apparatus are generally employed to position and anchor various types of members in a tubular member such as by way of example, a well bore casing or tubular member. One type arrangement employs hydraulics wherein a ball, or other type closure member is employed to accomplish the desired manipulation of the setting tool arrangement to enable a member to be positioned as desired in a well bore tubular member.

A mechanical means of some type is another alternative to positioning and anchoring a member in a tubular member such as disclosed and claimed in the above-referred to patent applications.

In employing a mechanical arrangement, some type of barrier or restraining means is employed to enable the necessary forces to be developed in a setting string to enable the apparatus be mechanically anchored in a well bore tubular member.

Applicant is not aware of any device presently available on the market wherein the mechanical setting arrangement includes an apparatus or stop means releasably coupled with a setting string along with a member to be positioned in a tubular member, which apparatus may be uncoupled from the setting string and anchored to the tubular member by manipulation of the setting string. Thereafter the setting string is manipulated and in cooperation with the anchored apparatus effects anchoring and positioning of the member in the tubular member. Disconnect means support the member on the setting string and the disconnect means is actuated by manipulation of the setting string to release the setting string from the member so that it may be manipulated to in turn position it so that the anchored apparatus or stop means may be uncoupled from the tubular member and retrieved along with the setting string.

Thus, the apparatus of the present invention provides a releasable barrier or stop means for positioning in a tubular member, such as a well bore tubular member on a setting string along with a member to be anchored in the tubular member so that necessary forces may be developed by manipulation of the setting string to anchor the member in the tubular member, and to enable the setting string to be thereafter manipulated to disconnect from the anchored member and also release the anchored apparatus, barrier or stop means for retrieval from the well bore tubular member when desired.

Another object of the present invention is to provide a method of anchoring a member in a tubular member wherein the member and an apparatus is releasably connected with a setting string and lowered, or positioned in a well bore tubular member. The setting string is manipulated to release from the apparatus or barrier and to releasably secure the barrier or stop with the well bore tubular member whereupon forces may be transmitted by manipulation of the setting string in cooperation with the secured apparatus to the member to anchor the member on the well bore tubular member. The setting string may then be manipulated to disconnect from the member and to also uncouple the apparatus from the well bore tubular member for retrieval from the well bore tubular member.

Still another object of the present invention is to provide a method and apparatus for releasably anchoring a member in a well bore tubular member wherein the member and a stop means are releasably coupled on a setting string and lowered into a well bore tubular member. The setting string is manipulated to release the stop means from the setting string and anchor it to the well bore tubular member whereupon additional tension may be developed in the setting string to engage the member with the anchored stop means for actuating anchor means on the member and anchoring the member in the well bore tubular member. Disconnect means between the member and the well string are responsive to additional tension in the operating string to release the operating or setting string from the anchored member. Means enable the stop means to uncouple from the well bore tubular member for retrieval along with the setting string from the well bore tubular member.

Other objects and advantages of the invention will become more readily apparent from a consideration of the following drawings and descriptions.

BRIEF DESCRIPTION OF THE DRAWINGS

FIGS. 2 and 3 are longitudinal vertical sectional views similar to FIGS. 1A and 1B and represent the relative position of the components of the present invention after the releasable stop means has been anchored to the tubular member and the member which is supported on the setting strip anchored to the tubular member;

FIG. 6 is a sectional view partly in elevation on the line 6—6 of FIG. 1A and illustrating structural details;

FIG. 7 is a sectional view on the line 7—7 of FIG. 6;

FIG. 8 is a sectional view on the line 8—8 of FIG. 1A; and

FIG. 9 is a diagramatic representation of the present invention in a well bore tubular member.

DESCRIPTION OF THE PREFERRED EMBODIMENTS

Figure 1A:
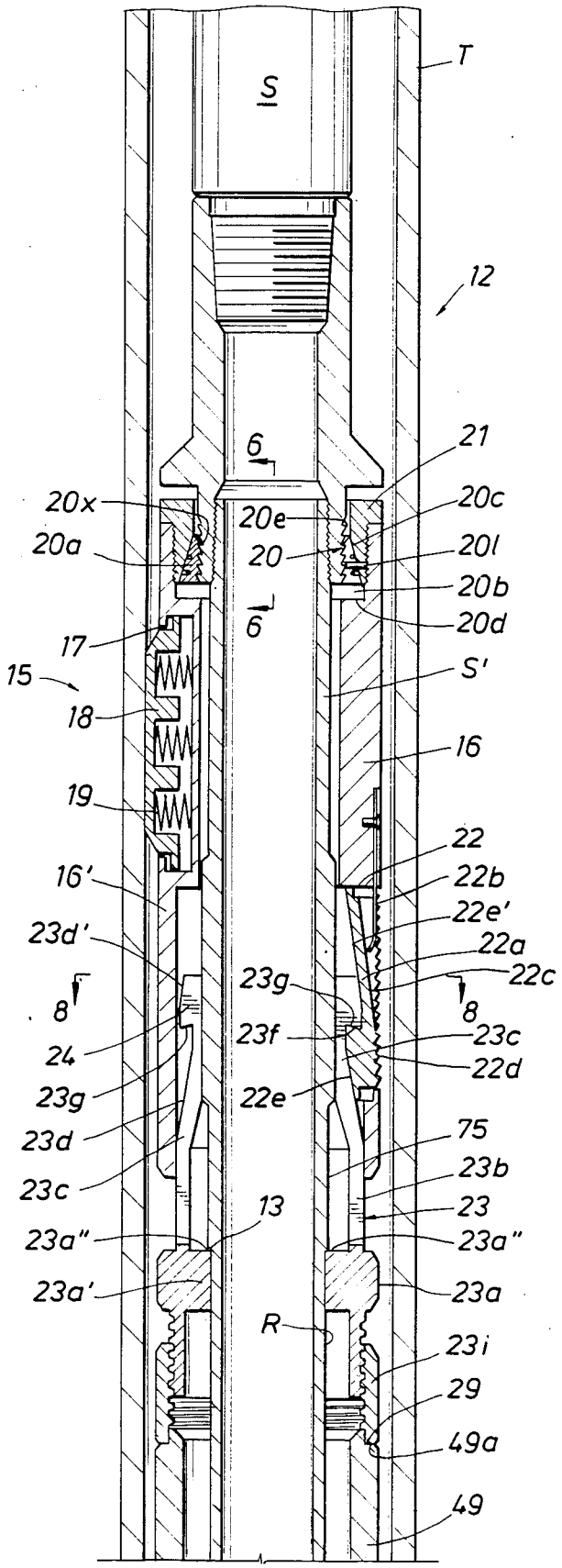
FIGS. 1A and 1B are longitudinal vertical sectional views illustrating the relative position of the components of the present invention as it is being positioned in a tubular member.

Attention is first directed to FIG. 1A wherein the apparatus of the present invention is referred to generally by the numeral 12. In the drawings, the invention 12 is shown as being positioned in a well bore tubular member T, but the well bore details are omitted, as such well bore surrounds the well bore tubular member T in a manner well known to those skilled in the art. FIG. 9 illustrates the well bore W with the tubular member T therein and diagramatically illustrates a drilling or work over mast M at the earth's surface E to enable the setting string S along with the present invention referred to generally at 12 to be lowered into the tubular member T by suitable drawworks means D of a type, and operated in manner well known in the art to accomplish the desired manipulation of the setting string S.

The setting string S includes a tubular mandrel S' connected therewith and which forms an extension of the setting string S upon which the apparatus referred to generally at 15 and the member referred to generally at 40 are supported. The apparatus or stop means 15 includes an annular housing means 16 having circumferentially spaced recesses or windows 17 therein as shown in the drawings. Longitudinally extending drag blocks 18 are received in the recesses 17 and urged outwardly of the housing means 16 by means of the springs 29 resting on the bottom of the recesses 17 and engaging the drag blocks to urge them outwardly of the housing means 16 for engaging with the interior surface of the tubular member T as illustrated in Fig. A of the drawings. The spring urged drag blocks 18 form restraining means on the housing to enable the setting string S to be manipulated in the operation of the invention as will be described hereinafter.

Releasable means referred to generally at 20 releasably support the apparatus or stop means 15 on the setting string S and include a segmented ring **20*a* positioned in a recess 20*b* formed between the setting string S and the housing means 16 as shown in the drawings. The recess 20*b* may be considered as defined by the tapered annular surface 20*c*, the counter bore and its end 20*d* in the housing means 16 and the ratchet or threaded surface 20*e* formed on the outer annular surface of the setting string S, the details of which are better illustrated in FIGS. 6 and 7. The segmented ring 20*a* is provided with internal ratchet threads 20*x* for engaging with ratchet surface 20*e*. It will be noted that the surface 20*c* is provided with an undercut 20*f* for receiving the upper end of the segmented cone 20*a* to inhibit or limit upward longitudinal and relative movement between the ring 20*a* the housing 16**.

As shown, the segmented ring **20*a* is formed by three segments, but any suitable number of segments may be employed. The outer annular surface 20*a'* of the segmented ring 20*a* is provided with annular grooves 20*g* in which are positioned annular resilient spring members 20*h* formed of suitable metal or the like which tend to collapse the segments of the segmented ring inwardly so that the threaded surface 20*i* on the segmented ring locklingly engages with the threaded portion 20*e* formed on the setting string S, as better illustrated in FIG. 6 of the drawings. One of the resilient spring members, such as the member 20*h* is provided with an enlargement 20*j* which is positioned in the recess formed between the termination of two of the segments to space them apart and to maintain them spaced apart for receiving the lock screw 20*l* therein as better seen in FIG. 7. The lock screw 20*l* extends from the outer surface of the annular housing 16 through the cap 21 on the upper end of the housing 16 and into the segmented ring 20*a* as shown in FIG. 1A of the drawings to prevent rotation thereof while accomodating longitudinal movement as will be described. The foregoing described releasable means 20 serves to restrain relative movement between the setting string S and the housing means 16** as will be described, for further operation of the invention.

The housing means 16 also includes tubular member engaging means comprising openings 22 longitudinally spaced from the windows or recesses 17 in the housing 16 for receiving slip segments **22*a* therein. Spring means 22*b* mounted on the housing 16 as illustrated by any suitable means fits in the longitudinally extending grooves 22*c* in the outer surface of the slip segments 22*a* and tend to urge the slip segments 22*a* into retracted position within the windows 22 when the invention is being lowered into a well bore tubular member as illustrated in FIGS. 1A of the drawings. The slip segments 22*a* are provided with serrated surfaces 22*d* for frictionally engaging and anchoring the housing or apparatus 16** to the tubular member T by manipulation of the setting string S.

Also forming part of the housing means 16 and supported thereby is the conical surface arrangement referred to generally at 23 for cooperating with the slip segments **22*a* to urge them out into anchoring relationship with tubular member T when the conical arrangement 23 is moved longitudinally of the housing 16. The conical arrangement 23 includes the annular member 23*a* and projecting upwardly therefrom is a longitudinally slotted portion 23*b* forming a plurality of circumferentially spaced and longitudinally extending fingers 23*c* which are provided with a first outer surface which is annular and inwardly tapered as illustrated at 23*d*, better illustrated in FIG. 8** of the drawings.

A second annular, tapered surface portion **23*d'* is provided on the enlarged annular outer end surface 24 of the fingers 23*c* as shown in FIG. 1A. The bottom or adjacent surface of the slip segments 22*a* are each provided with a pair of correspondingly tapered portions 22*e*, 22*e'* for engaging the tapered annular outer surface portions 23*d*, 23*d'* of the fingers 23*c*. At the juncture of the surfaces 22*e*, 22*e'*, an annular ledge 23*f* is formed on each finger 23*c* which is inwardly and upwardly sloping on the nether surface of the slip segments 22*a* as shown which conform with the annular sloping ledge 23*g* formed on each of the fingers 23*c* at the juncture of the sloping portions 23*d*, 23*d'*. The annular sloping ledges 23*f* and 23*g* form interlocking means to retain the conical surface arrangement 23 engaged with the slip segments carried by the housing 16 when the slip segments 22*a* are retracted in the windows 22, and in position to urge the segments 22*a* outwardly to anchor the housing 16 upon manipulation of the setting string S. The fingers 23*c* collapse inwardly into the depending skirt portion 16' of the housing 16 when the slip segments are disengaged from the tubular member T as will be described. The foregoing provides tubular member engaging means on the housing means or apparatus 16 for enabling the apparatus or stop means 16** to be releasably anchored with the tubular member T by manipulation of the setting string S.

The member or device 40 includes a longitudinally extending tubular body 41 and connecting means referred to generally at 60 connect the body means 41 with the setting string S for manipulation of the member 40 to releasably anchor it with the tubular member T and to thereafter to enable the setting string S to be released from the anchored member 40 for retrieval if desired. In some instances, the setting string S will also form the production string for the well bore.

Figure 1B:
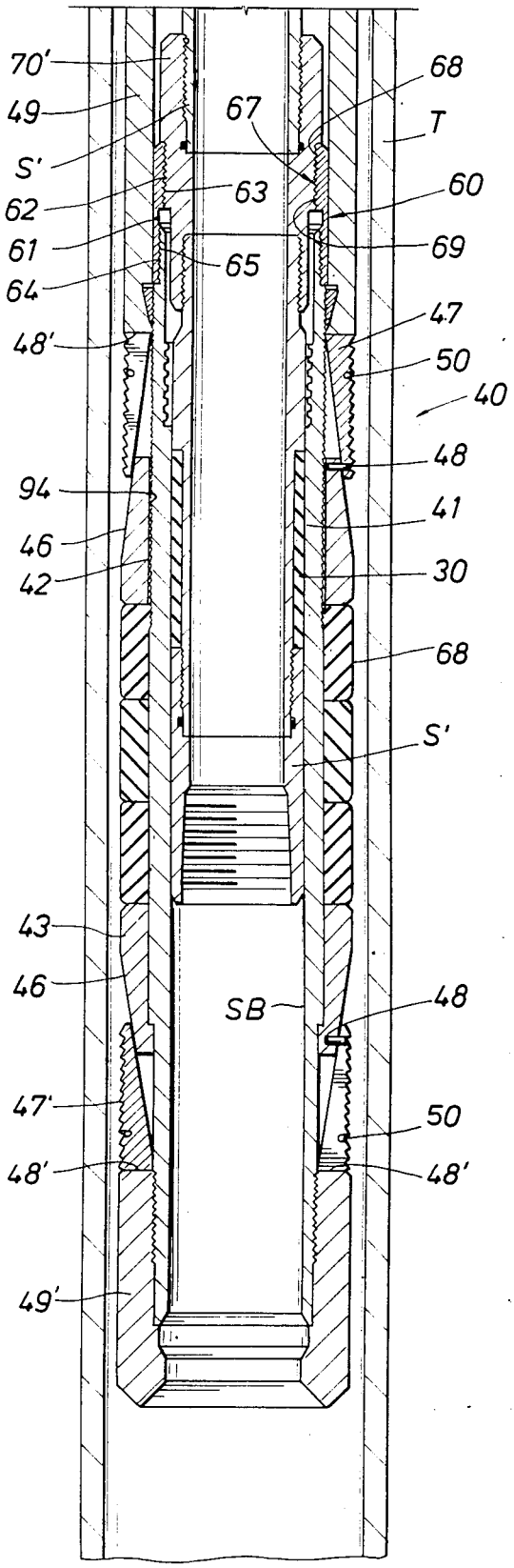

Annular members 42, 43 are longitudinally spaced and carried on the body 41 in any suitable manner as shown in FIG. 1B. Each of the annular members 42, 43 are provided with longitudinally extending annular tapered outer surfaces 46 on which are received annular, slip segments 47, 47'. The slip ring segments 47, 47' are initially secured to the members 42, 43, respectively, by any suitable frangible means such as the shear pins 48 to retain them in position and inhibit premature actuation of the slip segments 47, 47' as the invention is positioned in a tubular member. The slip segments 47, 47' abut the outer housings 49, 49' respectively at the slip segment ends 48'. The lower outer housing 49' is threadedly engaged with tubular body or packer barrel 41 and spaced from the lower end of upper outer housing 49 as shown to receive the slip segments 47, 47', annular members 42, 43 and packer or seal elements on packer barrel 41 therebetween as shown. The upper outer housing 49 receives packer barrel 41 therein to enable packer barrel 41 and setting string S to move longitudinally relative therein for setting packer 68 as will be described. The slip segments 47, 47' and annular members 42, 43 form tubular member engaging means on member 40. Suitable resilient spring means 50 are provided in a groove for encircling the ring segments 47, 47' to retain them in position on the annular members 42, 43 in a manner well known in the art. The foregoing arrangement may be referred to as the member tubular member engaging means and are of a well known configuration and construction so that further details thereof are believed unnecessary, and as being well known to those skilled in the art.

Figure 5A:
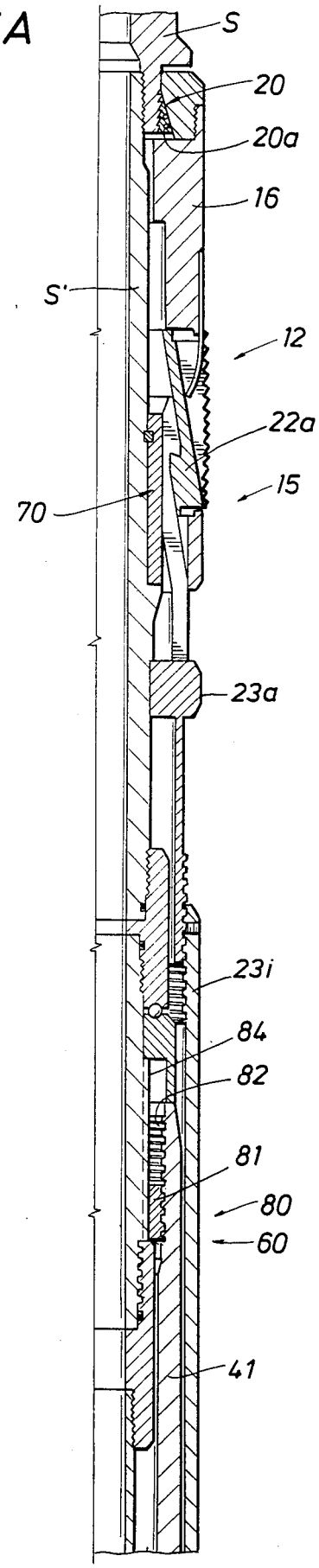
FIGS. 5A and 5B are partial longitudinal sectional views illustrating an alternate embodiment of the present invention and the relative position of the its components as it is positioned in a tubular member.

In the embodiments illustrated, it will be noted that the upper end of the longitudinal housing or body portion 49 of the member 40 abuts the lower end 29 of the coupling **23*i* threadedly connected with annular member 23*a* of conical surface arrangement 23 and depending downwardly from the lower end of the annular member 23*a* as shown in FIGS. 1A and 5A of the drawings. Also, the annular member 23*a* includes a radially inwardly projecting portion 23*a'* providing an annular shoulder 23*a''* which abuts the downwardly facing annular shoulder 13** formed on the mandrel S' at the juncture of the undercut portion R with the mandrel that forms an extension of the setting string S as shown in the drawings.

In FIG. 1B, the connecting means 60 is shown as including a frangible sleeve member 61 whose upper end 62 is secured to the tubular mandrel S' by any suitable means such as threads 63 or the like as shown in the drawings. The lower end 64 of the frangible sleeve or collar 61 is threadedly connected as illustrated at 65 to the upper end of the longitudinal tubular body 41.

The disconnect means 60 may also assume the form of a threaded arrangement referred to generally at 67 in the upper end of FIG. 1B and includes the external threads 68 on the collar 70' and the internal threads 69 on the upper end 62 of the frangible sleeve or collar 61.

Figure 4A:
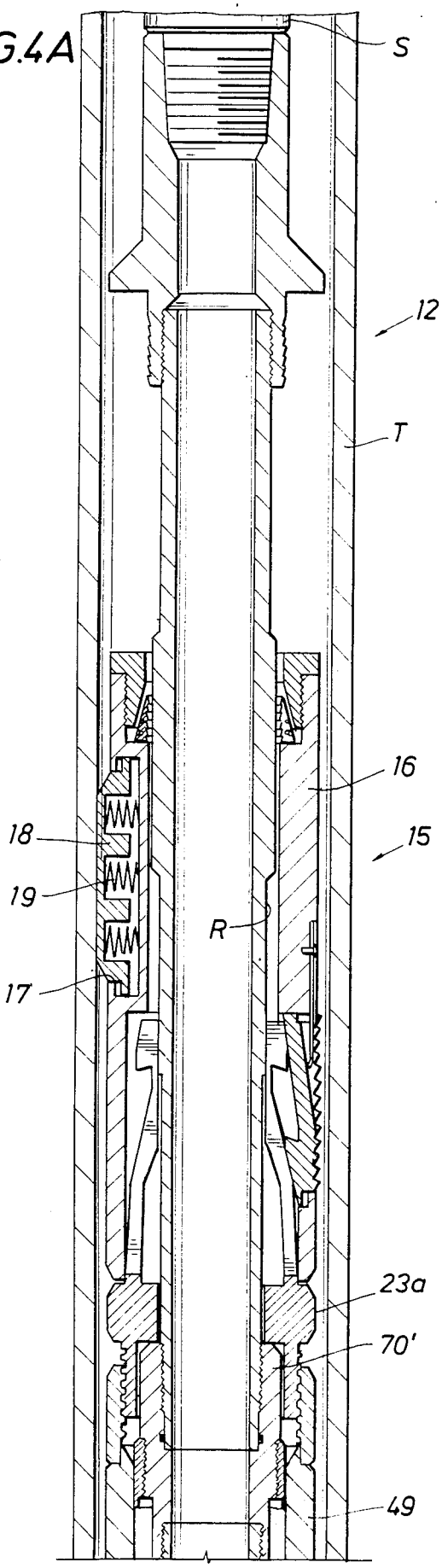
FIGS. 4A and 4B are longitudinal sectional views similar to FIGS. 1A and 1B but demonstrate the relative position of the components after the setting string has been uncoupled or released from the anchored member in the tubular member and the setting string positioned to release the anchored apparatus or stop means.
Figure 4B:
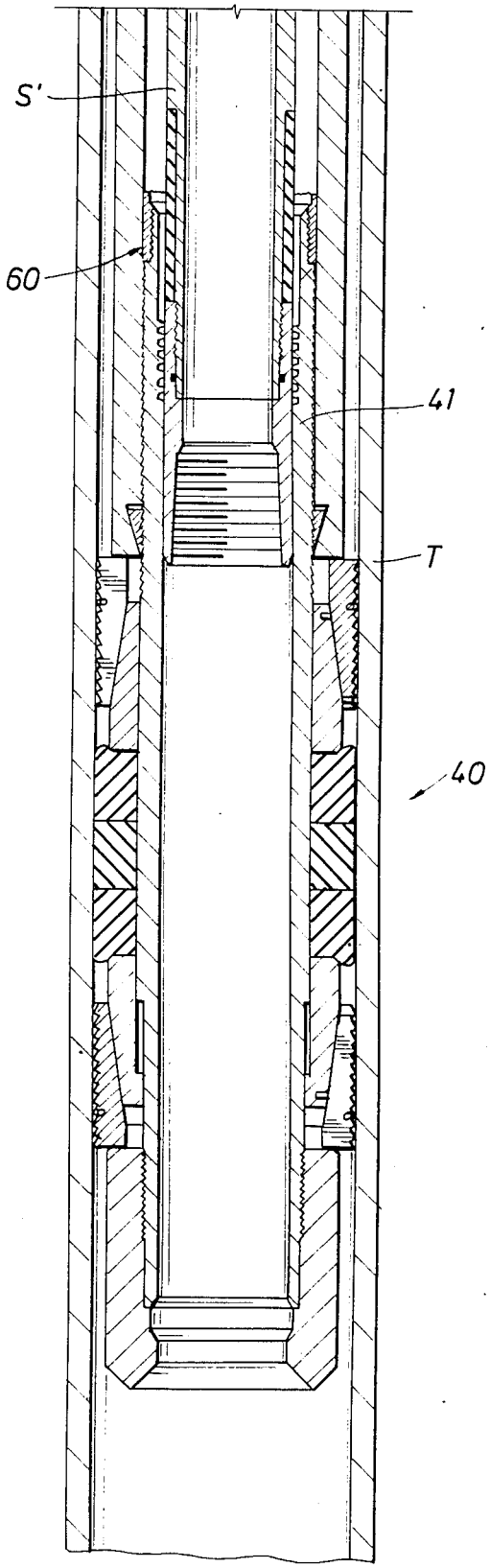
Figure 5B:
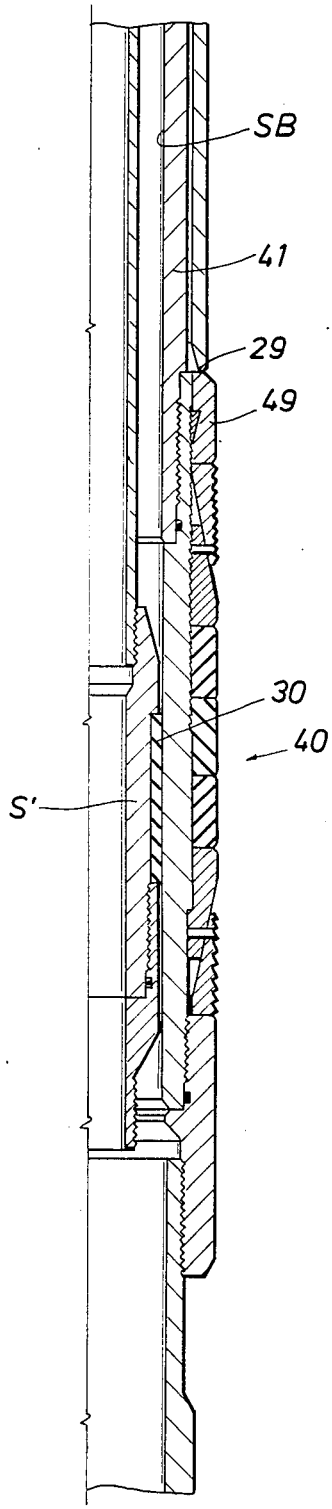

After the member 40 has been anchored to the well bore tubular member T as illustrated in FIG. 3, or 4B, the setting string S may be manipulated either by rotation or by applying tension thereto to disconnect the setting string S from the anchored member 40. If rotation is imparted, the threads 68, 69 will enable the mandrel portion S' to release from the body 41, or if the setting string S is manipulated by applying tension thereto sufficient to break the frangible collar or sleeve 61 between the connections at 63 and 65 as shown in FIGS. 4A and 4B, then this also will disconnect the setting string S and mandrel S' from the body 41 and anchored member 40.

Where rotation is employed to disconnect the setting string S from the anchored member 40, the arrangement illustrated in FIG. 5A and 5B may also be employed. In such arrangement sleeve bearing means referred to at 70 are provided between the setting string mandrel S' and the housing tubular member engaging means 15 to accommodate rotation of the setting string S' relative to the conical surface arrangement 23 and slip segments **22*a* which anchor to tubular member T to disengage the threaded connection represented generally at 80. The sleeve bearing 70 is shown as being supported on a shoulder of the setting string. The threaded connection 80 may include a left hand nut 81 and a left hand threaded portion 82 so that upon right hand rotation of the setting string S' the left hand nut 81 will move longitudinally upward along the noncircular portion represented in dotted line at 84 on the setting string mandrel S' to disconnect the mandrel S' and setting string S from the body 41 of the member 40. The threaded portion 82 is of substantial extent in relation to the length of the ratchet surface 20*x* on ring 20*a* to assure that the connection 80 will not actuate when the setting string S is rotated to release the housing 16** from the setting string S.

Operation of the Tool

FIGS. 1A and 1B illustrate the position of the relative components of the invention as it is lowered into the well bore or positioned in a tubular member. During such operation, the apparatus or stop means 15 is releasably secured to the setting string S by the arrangment 20. The lower end 29 of conical surface arrangement 23 abuts against the upper end **49*a* of the outer housing 49 of the member 40 as shown in the drawings. Similarly, the shoulder 23*a''* on annular member 23*a* and shoulder 13 on mandrel S' abut and all of the foregoing serve to assist in maintaining the apparatus 16 and member 40** releasably secured in inactive position on the setting string S as it is lowered into a well bore tubular member T.

When the elevation is reached in the well bore tubular member T at which it is desired to activate the invention 12 and anchor the member 40 in the tubular member T, the setting string is manipulated to first release the apparatus or stop means 15 from the setting string and to releasably anchor it to the tubular member T so that it will function as a barrier to enable subsequent operation of the invention to occur to anchor the member 40 in the tubular member T.

To accomplish this in the embodiments illustrated, the setting string S is rotated and upon rotation, it threadedly disconnects from the segmented ring **20*a* so that the setting string S may be moved upwardly as represented by the arrow 32 in FIG. 2. Relative rotation between the setting string S and the stop means 15 is accommodated since the drag blocks 18 tend to restrain rotation of the housing means 16 as the setting string is rotated. Also, as the setting string S is rotated, the lock screw 20*l* restrains rotation of the segmented ring 20*a* so that relative rotation of the setting string S and release means 20 may occur to effect disengagement therebetween and release of stop means 15** from the setting string.

After the setting string S has been threadedly disengaged from the release means 20 between the setting string S and apparatus or stop means 15, the setting string S may be pulled upwardly relative to stop means 15 to create a first predetermined tension in the setting string. Since the outer housing 49 and member 40 are connected to the setting string S by the connection 60, the upper end 49*a* of housing 49 moves the conical surface arrangement 23 longitudinally relative to housing means 16, as longitudinal movement of housing means 16 will be restrained by the drag blocks 18. This moves segments 22*a* radially outward of housing 16 and engages the slip segments 22*a* with the tubular member T as shown in FIG. 2 of the drawings and anchors or releasably secures the apparatus or stop means 15 to the well bore tubular member T.

Continued manipulation of the setting string by exerting a second or a higher predetermined tension thereon will cause the frangible means 48 to break so that the inner body 41 and connected string S may move upwardly relative to the upper outer body 49. The outer body 49 is restrained against upward longitudinal movement by reason of its abutting relationship with the lower end 29 of the conical surface arrangement 23 and conical surface arrangement 23 is held against longitudinal upward movement since fingers 23*c* are abutted against slip segments 22*a* which are secured with tubular member T. It can be appreciated that the shear strength of the frangible means 48 will be predetermined so that it will not prematurely shear during release of the stop means from the setting string and anchoring of the releasable stop means 15 to the tubular member T as above described.

After the shear means 48 has been sheared, the inner body or packer barrel 41 which is connected to the setting string S may move longitudinally upwardly with the setting string S′ in response to the second tension and this causes the slip segments 47, 47′ to move radially outwardly by sliding upon the annular members 42 and 43. The upper segment ring 47 is restrained against upward movement by its end 48′ abutting the lower end of housing 49. The lower segment ring 47′ is urged upwardly since its end 48′ abuts the upper end of outer housing 49′ secured to the lower end of tubular body or packer barrel 41 and moves therewith when the second tension is applied to the setting string S. This causes segment rings 47, 47′ to move radially outward and anchor to the tubular member T. As they move radially outwardly, the annular members 42, 43 compress the packing member 68 and urge it radially outwardly as illustrated in FIG. 3 of the drawings to sealingly engage with the tubular member T.

To assure that the packer or seal means 68 maintains its expanded and sealing relationship with tubular member T, suitable means as referred to generally at 90 may be provided and form a retaining or locking means. Such means include a ring 91 which fits in the tapered recess 92 formed in the upper outer housing or longitudinal body 49. The ring 91 is provided with a threaded or ratchet surface 93 on its bore and a matching ratchet or threaded surface 94 is provided on the outer surface of the packer barrel or inner tubular body 41. Thus, as the inner tubular body 41 is moved upwardly by the second tension in the setting string S, it ratchets through the ring 91 and when the packer 68 has been set and the slips 47, 47′ anchored to the well bore tubular member T, the ratchet surfaces 93, 94 lockingly engage the body 41 to upper housing 49 and lock the slips 47, 47′ and segments 42, 43 in the position shown in FIG. 3 of the drawings.

Where it is desired to manipulate the setting string S by pulling to actuate the disconnect means 60, the tension required in the setting string to break the frangible collar 61 will be a predetermined amount higher than the second tension required to shear the shear means 48 of the member 40. The third predetermined tension necessary to break the frangible collar or sleeve 61 is applied to the setting string when it is desired to disconnect from the anchored member 40 so as to shear or break the collar 61 whereupon the setting string S may be moved to the position demonstrated in FIG. 4A of the drawings wherein the recessed or undercut portion R will be positioned adjacent the housing tubular engaging means comprising the slips 22*a* and conical arrangement 23*a* so that the fingers 23*c* may withdraw into the recessed portion R as the setting string S is moved longitudinally thereby enabling the slips 22*a* to disengage from the tubular member T so that stop means 15 releases from the tubular member T for retrieval along with the setting string.

From the foregoing, it can be appreciated that the setting string S is manipulated to first release it from the apparatus or stop means 15 whereupon a first tension applied to the setting string moves it longitudinally so that as the stop means is restrained by drag members 18, the resulting tension acts through the member 40 and its upper body 49 to act on the housing tubular member engaging means to engage with the tubular member T as shown in FIG. 2 of the drawings.

Thereafter, a second and higher predetermined tension is applied to the setting string T to shear or break the frangible member 48 and anchor the member 40 with the tubular member T. Where a packer 68 is employed with the member 40, the packer 68 will at such time also be actuated to sealingly engage with the tubular member.

After the member 40 has been anchored to the tubular member T, a third and higher and predetermined tension may be applied to break the frangible sleeve or collar 61 to disconnect the setting string and mandrel from the anchored member 40, whereupon the setting string moves longitudinally to position the recess surface R beneath the conical surface arrangement 23*a* so that the fingers 23*c* may retract into skirt 16′ of housing 16 to enable the slip segments 22*a* to uncouple from the tubular member T to be retrieved with the setting string from the well bore. The conical arrangement 23*a* is carried by the slips 22*a* and is also retrieved from the tubular member.

If desired, before disconnecting the setting string from the member 40, hydrostatic pressure may be conducted through the setting string to test the seal 68 to assure that the seals 68 are sealable engaging with the well bore tubular member T.

After the setting string S has been disconnected from packer body 41 by operating the form of disconnect 60 as shown in FIGS. 1B and 5A, or the form shown at 67 in FIG. 1B, the setting string S and all other components except member 40 and its associated parts may be removed from the tubular member.

In this method, this is accomplished by lowering the setting string. The released housing 16 is restrained during such downward movement of the setting string by drag blocks 18 and when the ratchet surface 20*e* on string S strikes ratchet surface 20*x*, segmented ring 20*a* expands as it moves downwardly in recess 20*b* so that 20*x* and 20*e* may lockingly engage. String S and stop means 15 may then be withdrawn from the well bore and a well production string with a seal nipple thereon may be lowered to sealingly and slidably engage in seal bore SB formed by the internal seal bore SB of packer body 41. If desired, packing elements may be positioned on the setting string S for sealing and sliding engagement with seal bore SB after the setting string S has been disconnected from packer body 41 and member 40I to thereby eliminate removal of the setting string S and replacement with a tubing, or production string.

The invention has been described in its application to positioning a packer in a well bore tubular member, by way of example only. The invention may be employed in any environment to position any type of device in any tubular member such as a pipeline, or vertical or horizontal shaft.

The releasable means 20 may assume other forms. For example, a J latch arrangement may be employed in lieu of the specific releasable means shown in the drawings.

The foregoing disclosure and description of the invention are illustrative and explanatory, thereof, and various changes in the size, shape and materials as well as in the details of the illustrated construction may be made without departing from the spirit of the invention.

What is claimed is:

1. Apparatus for supporting on a setting string for securing in a tubular member in a well bore whereby tension may then be provided by manipulating the setting string and transmitted to tubular member engaging means on a member to anchor the member in the tubular member comprising:

a longitudinal mandrel for connecting with the setting string;

means to support the member on said mandrel;

housing means on said mandrel;

releasable means releasably connecting said housing means and mandrel;

restraining means on said housing means engageable with the tubular member to restrain said housing means upon manipulation of the setting string to disconnect said mandrel from said housing for relative movement therebetween;

slip means on said housing means for securing said housing means with the tubular member when said slip means is urged from a retracted position to move outwardly and engage the tubular member;

slip actuating means;

surface means operative upon movement of the setting string relative to said housing means to engage and urge said slip means from retracted position to secure said housing means with the tubular member;

engaging means on the member operable by manipulation of the setting string relative to said secured housing means to engage and anchor the member in position in the tubular member;

connecting means releasably connecting the member to said mandrel said connecting means operable by manipulation of the setting string after the member has been anchored in position in the tubular member to release said mandrel from the member; and said releasable means including a segmented ring within an annular recess between said housing means and mandrel, said ring having an internal threaded portion for engaging an external threaded portion on said mandrel, lock means for restraining rotation of said ring upon rotation of said mandrel to thereby disconnect said mandrel and housing means, said segmented ring having resilient means for accommodating expansion thereof to enable said mandrel to ratchet into said ring when the setting string is moved longitudinally toward said housing means secured with the tubular member whereby said housing means and setting string reconnect for release of said housing means from the tubular member.

2. The apparatus of claim 1 wherein said connecting means includes frangible means responsive to tension in the setting string to break and release said mandrel from the anchored member.

3. The apparatus of claim 1 wherein said surface means including at least one tapered surface on each said slip actuating means and slip means which are in contact and surface means on said slip actuating means conforming with annular surface means on said mandrel.

4. The invention of claim 1 wherein the annular recess which receives said segmented ring is or greater longitudinal extent than said ring to accommodate expansion of said ring as said mandrel ratchets into said ring.

5.

A method of anchoring a member with anchor means thereon to a well bore tubular member by manipulating a setting string connected with a mandrel having housing means threadedly supported thereon and the member sealably connected therewith, the housing means having means to restrain relative movement between it and the mandrel to enable the mandrel to be manipulated for disconnecting from the housing means for relative longitudinal movement between the mandrel and housing means whereupon slip means supported on the housing means may be moved outwardly from a retracted position by slip actuating means to releasably secure the housing means to the tubular member which thereafter enables the setting string to be manipulated to anchor the member to the tubular member, release the mandrel from the anchored member while maintaining them engaged in a sealing relationship comprising the steps of:

positioning the mandrel, housing means and member on the setting string;

lowering the setting string with the mandrel, housing means and member into the well bore;

rotating the setting string to threadedly disconnect the housing means from the mandrel;

maintaining the slip actuating means and slip means in contact while the slip means is in retracted position during lowering of the setting string in the well bore and while threadedly disconnecting the housing means from the mandrel;

manipulating the setting string to move the mandrel and slip actuating means to urge the slip means into engagement with the tubular member to secure the housing means thereto;

manipulating the setting string to actuate the member anchor means and anchor the member to the tubular member; and manipulating the setting string to release from the anchored member and remain in a sealing relationship therewith.

6. The method of claim 5 wherein the setting string is manipulated by applying a tension to the setting string to release the setting string from the anchored member and to disengage the slip means from the tubular member.

7. The method of claim 5 wherein the setting string is manipulated by rotation to release the setting string from the anchored member.

8. A method of anchoring a member with anchor means thereon to a well bore tubular member by manipulating a setting string connected with a mandrel having the member connected therewith, a recessed portion on the mandrel and housing means threadedly supported on the mandrel, the housing means having means to restrain relative movement between it and the mandrel to enable the mandrel to be rotated to threadedly disconnect it from the housing means for relative longitudinal movement between the mandrel and housing means whereupon slip means supported on the housing means may be moved outwardly from a retracted position by slip actuating means to releasably secure the housing means to the tubular member which thereafter enables the setting string to be manipulated to anchor the member to the tubular member, release the mandrel from the anchored member, and then retrieve the setting string with the mandrel and housing means from the well bore comprising the steps of:

positioning the mandrel, housing means and member on the setting string;

lowering the setting string with the mandrel, housing means, and member into the well bore;

rotating the setting string to threadedly disconnect the housing means from the mandrel;

maintaining the slip actuating means and the slip means in contact while the slip means is in retracted position during lowering of the setting string in the well bore and while threadedly disconnecting the housing from the mandrel;

manipulating the setting string to move the mandrel and slip actuating means to urge the slip means into engagement with the tubular member to secure the housing means thereto;

manipulating the setting string to actuate the member anchor means and anchor the member to the tubular member;

manipulating the setting string to release from the anchored member;

manipulating the setting string to position the mandrel recessed portion to receive the slip actuating means and enable the slip means to retract and disconnect from the tubular member; and manipulating the release setting string to connect the mandrel with the housing means for retrieval with the setting string from the well bore.

9. Apparatus to lower on a setting string and anchor in position in a well bore tubular member a member having tubular member engaging means to secure the member with the tubular member including:

a mandrel for securing with the setting string;

housing means;

means to releasably support said housing means on said mandrel, said mandrel being disconnectable from said housing means for securing said housing means with the tubular member by manipulating the setting string;

slip actuating means;

slip means;

surface means on said mandrel to maintain said slip means and slip actuating means in contact in retracted position as the apparatus is lowered in the well bore, said surface means and slip actuating means movable by said mandrel after said housing means is secured to the tubular member to urge said slip means outwardly from retracted position to engage said slip means with the tubular member and secure said housing means thereto whereby said mandrel may then be manipulated to actuate the tubular member engaging means and anchor the member in the tubular member;

connecting means to release said mandrel from the anchored member; and additional surface means on said mandrel positionable by the setting string to accommodate retraction of said slip actuating means and slip means to retracted position.

10. The invention of claim 9 wherein said surface means includes larger diameter surface means on said mandrel and surface means on said slip actuating means in contact with said larger diameter surface means on said mandrel when said slip means is in retracted position as the apparatus is lowered in the well bore and wherein said surface additional means on said mandrel to accommodate retraction of said slip actuating means is a recessed portion adjacent said larger diameter surface.

11. Apparatus to lower on a setting string and anchor in position in a well bore tubular member a member having tubular member engaging means to secure the member with the tubular member including:

a mandrel for securing with well string to depend therefrom;

housing means for releasably supporting on said mandrel, said housing means being disconnectable from the mandrel for securing with the tubular member by manipulating the setting string;

slip actuating means;

slip means;

support means on the member to maintain said slip actuating means and slip means engaged in retracted position as the apparatus is lowered in the well bore, said support means movable by manipulating the well string after said housing means is secured to the tubular member to move said slip actuating means for urging said slip means outwardly to engage said slip means with the tubular member and secure the releasable means thereto whereby said mandrel and the setting string may then be manipulated to actuate the tubular member engaging means and anchor the member in the tubular member;

connecting means operable by manipulating the setting string to release said mandrel from the member anchored in the tubular member; and surface means on said mandrel and movable therewith upon manipulation by the setting string to accommodate movement of said slip actuating means for release of said slip means from engagement with the tubular member.

12. The apparatus of claims 1 or 9 or 11 including means to accommodate rotation of the setting string relative to said slip actuating means and slip means when said housing means is secured to the tubular member whereby said connecting means may be actuated to release the setting string from the anchored member.

13. The apparatus of claims 1 or 9 or 11 including seal means on said mandrel for sealing and sliding engagement within the anchored member after said connecting means is actuated to release said mandrel from the anchored member.

14. The apparatus of claims 1 or 9 or 11 wherein said connecting means comprises threaded means which disconnect said mandrel and anchored member upon relative rotation therebetween.

15. The apparatus of claims 1 or 9 or 11 wherein said slip actuating means and slip means have interlocking surface means.

16. The apparatus of claims 1 or 9 or 11 wherein said connecting means includes frangible means responsive to tension in the setting string to break for releasing said mandrel from the anchored member.

17. The apparatus of claim 11 wherein said support means includes shoulder means on said mandrel against which said slip actuating means is supported in retracted position, body means supported on said member and connected with said slip actuating means to assist in maintaining said slip actuating means and slip means engaged in retracting position.

18. In an apparatus for supporting on a setting string to be lowered in a well bore tubular member wherein a mandrel is connected to and extends from the setting string with housing means supported on the mandrel and releasable therefrom by manipulation of the setting string for relative movement between the mandrel and housing means whereby slip means and slip actuating means associated with the housing means is operable by the mandrel to urge the slip means from a retracted position to move outwardly to engage and secure the housing means to the tubular member whereby the setting string and mandrel may then be manipulated to anchor a member in position in the tubular member and the mandrel then released from the member, the invention including:

support means on the mandrel to maintain the slip actuating means and slip means substantially in abutting relationship while in retracted position as the apparatus is lowered in the well bore, said support means and the slip actuating means movable longitudinally by longitudinal movement of the setting string after the housing means is secured to the tubular member whereby the slip means is urged outwardly to engage and secure the housing means to the tubular member so that the setting string may then be manipulated to anchor the member in the tubular member and the mandrel released therefrom; and additional means on the mandrel positionable after releasing the mandrel from the anchored member to accommodate retraction of said slip actuating means and slip means from engagement with the tubular member to retracted position.

* * * * *